US009084926B2

(12) United States Patent
Hartford, Jr.

(10) Patent No.: US 9,084,926 B2
(45) Date of Patent: Jul. 21, 2015

(54) SKI STORAGE SYSTEM AND METHOD

(76) Inventor: William J. Hartford, Jr., Silver Creek, NY (US)

( * ) Notice: Subject to any disclaimer, the term of this patent is extended or adjusted under 35 U.S.C. 154(b) by 0 days.

(21) Appl. No.: 13/525,328

(22) Filed: Jun. 17, 2012

(65) Prior Publication Data

US 2012/0319391 A1 Dec. 20, 2012

Related U.S. Application Data

(60) Provisional application No. 61/498,580, filed on Jun. 19, 2011.

(51) Int. Cl.
*A63C 11/02* (2006.01)

(52) U.S. Cl.
CPC ..... *A63C 11/021* (2013.01); *A63C 11/023* (2013.01); *Y10T 29/49947* (2015.01)

(58) Field of Classification Search
USPC ..... 280/809, 814, 815; 206/315.1; 150/154; D3/254, 261
See application file for complete search history.

(56) References Cited

U.S. PATENT DOCUMENTS

| | | | | |
|---|---|---|---|---|
| 4,830,403 | A * | 5/1989 | Ohmori | 280/815 |
| 5,022,678 | A * | 6/1991 | Mayfield | 280/815 |
| D329,743 | S * | 9/1992 | Heisick | D3/261 |
| 5,207,323 | A * | 5/1993 | McConnell | 206/315.1 |
| 6,736,263 | B1 * | 5/2004 | Smith | 206/315.1 |

* cited by examiner

*Primary Examiner* — John Walters

(57) ABSTRACT

A ski storage system may include a first sleeve length of elastic material having a first aperture configured to receive a first ski. A second sleeve length of elastic material may include a second aperture configured to receive a second ski. A hanging fastener may be positioned in between and configured to vertically suspend the first and the second sleeve lengths.

18 Claims, 5 Drawing Sheets

SKI STORAGE SYSTEM AND METHOD

I. CLAIM OF PRIORITY

This application is a continuation patent application of, and claims priority from, U.S. Provisional Patent Application Ser. No. 61/498,580, filed on Jun. 19, 2011 and entitled "Ski Covering," which is incorporated by reference herein in its entirety for all purposes.

II. FIELD OF THE DISCLOSURE

The present disclosure relates generally to skiing equipment, and more specifically, to ski storage and protection.

III. BACKGROUND

Skis should be stored properly to maintain their value and performance attributes. For example, moisture on the skis or in their storage environment can cause rust and corrosion. Conventional storage techniques involve placing skis in a bag or clamping their bases together. Such techniques can cause structural deformity or other damage to skis. Ski edges include metal edges that can scrape and scratch the softer plastic of the base. In addition to wear on the bases, moisture may migrate to the metal edges of the skis. Such damage to the skis can detrimentally affect downhill performance.

IV. SUMMARY OF THE DISCLOSURE

In a particular embodiment, an apparatus may include a first sleeve length of elastic material comprising a first aperture configured to receive a first ski. A second sleeve length of elastic material may include a second aperture configured to receive a second ski. A hanging fastener may be positioned in between and be configured to vertically suspend the first and the second sleeve lengths.

The apparatus may further include a non-elastic section positioned in between the first sleeve length and the second sleeve length. At least one of the first sleeve length and the second sleeve length may include an inner layer comprising a moisture wicking material, such as COOLMAX® material. An overlock stitch may be used proximate the aperture to discourage fraying. The hanging fastener may include a hoop mechanism, or ring. In another embodiment, the hanging fastener may include hook, nail, or other attachment mechanism.

An embodiment of another ski storage system may include a second non-elastic section positioned in between the first sleeve length and the second sleeve length. A center elastic section may be positioned in between the first non-elastic section and the second non-elastic section.

In a particular embodiment, the first sleeve length and the second sleeve length are integrally attached. At least one of the first sleeve length and the second sleeve length may include a round, unspun fiber. At least one of the first sleeve length, the non-elastic section, and the second sleeve length may include a recycled material. At least one of the first sleeve length, the non-elastic section, and the second sleeve length may include a material comprising at least one of polyester, bamboo, flan, and hemp. Another exemplary material may include TWARON®, or another cut resistant material. At least one of the first sleeve length, the non-elastic section, and the second sleeve length may be personalized with at least one of a logo and text.

According to another particular embodiment, a method of manufacturing a ski covering includes forming a first sleeve length of elastic material comprising a first aperture configured to receive a first ski. A second sleeve length of elastic material comprising a second aperture configured to receive a second ski may be formed. A hanging fastener may be positioned in between and configured to vertically suspend the first and the second sleeve lengths.

A non-elastic section may be positioned in between the first sleeve length and the second sleeve length. An inner layer comprising a moisture wicking material may be included inside at least one of the first sleeve length and the second sleeve. The embodiment of the method may further include using an overlock stitch proximate the aperture. The first sleeve length and the second sleeve length may be integrally attached. The forming of the first sleeve length and/or the second sleeve length may include using a round, unspun fiber. The embodiment of the method may further include forming at least one of the first sleeve length, the non-elastic section, and the second sleeve length using at least one of a recycled material, polyester, bamboo, flan, and hemp. At least one of the first sleeve length, the non-elastic section, and the second sleeve length may be personalized with at least one of a logo and text.

Features that characterize embodiments are set forth in the claims annexed hereto and forming a further part hereof. However, for a better understanding of embodiments, and of the advantages and objectives attained through their use, reference should be made to the drawings and to the accompanying descriptive matter.

V. BRIEF DESCRIPTION OF THE DRAWINGS

VI. DETAILED DESCRIPTION

An embodiment of an apparatus, or ski storage system, may enable skis to be hung from a ring fastener for months without slipping. The skis may thus be stored between uses or during the offseason. The sleeves of the ski storage system are flexible and may be used on a wide variety of ski types, as well as with skis of different sizes. The ski covering may be personalized and labeled with promotional logos or text. An embodiment may be manufactured from elastic material blended with polyester or recycled material, and may comprise a variety of colors.

A particular embodiment of a ski storage system may include polyester and elastic to hold skis securely. An inner surface of the sleeves of the ski storage system may be plated or otherwise lined with COOLMAX® or another moisture-wicking fabric that draws moisture away from ski edges to avoid rust. Moreover, the fabric may be plated such that moisture is wicked from the entire ski area.

The ski storage system may hold skis together while keeping two layers of material between the sharp edges and the delicate bases of the skis. The material of the ski storage system may comprise a wide variety of colors, and may include recycled plastics and glass. The material may be machine washed and dried.

In practice, the system for storage and protection of skis may include sleeves having openings that may be pulled over respective ski tips. Both skis may be separated by two layers of material at all times. The center loop may be centered on the ski tips. Hanging by the loop keeps the skis out of the way and prevents them from falling over. The hanging further prevents wicking moisture from ground.

Non-elastic middle sections may be included in an embodiment of the ski storage system. The non-elastic sections may have the same or a different diameter sleeve than the first or second sleeve lengths. The non-elastic sections may facilitate the ski storage system's fitting around the shape of the skis. For example, relief (e.g., non-elasticity) in the areas of a non-elastic section may allow the ski storage system conform to help hold and suspend the skis. As such, one size of the ski storage system may fit substantially all sizes and shapes of skis. An Overlock stitch proximate the aperture may be used to discourage fraying.

Figure 1:
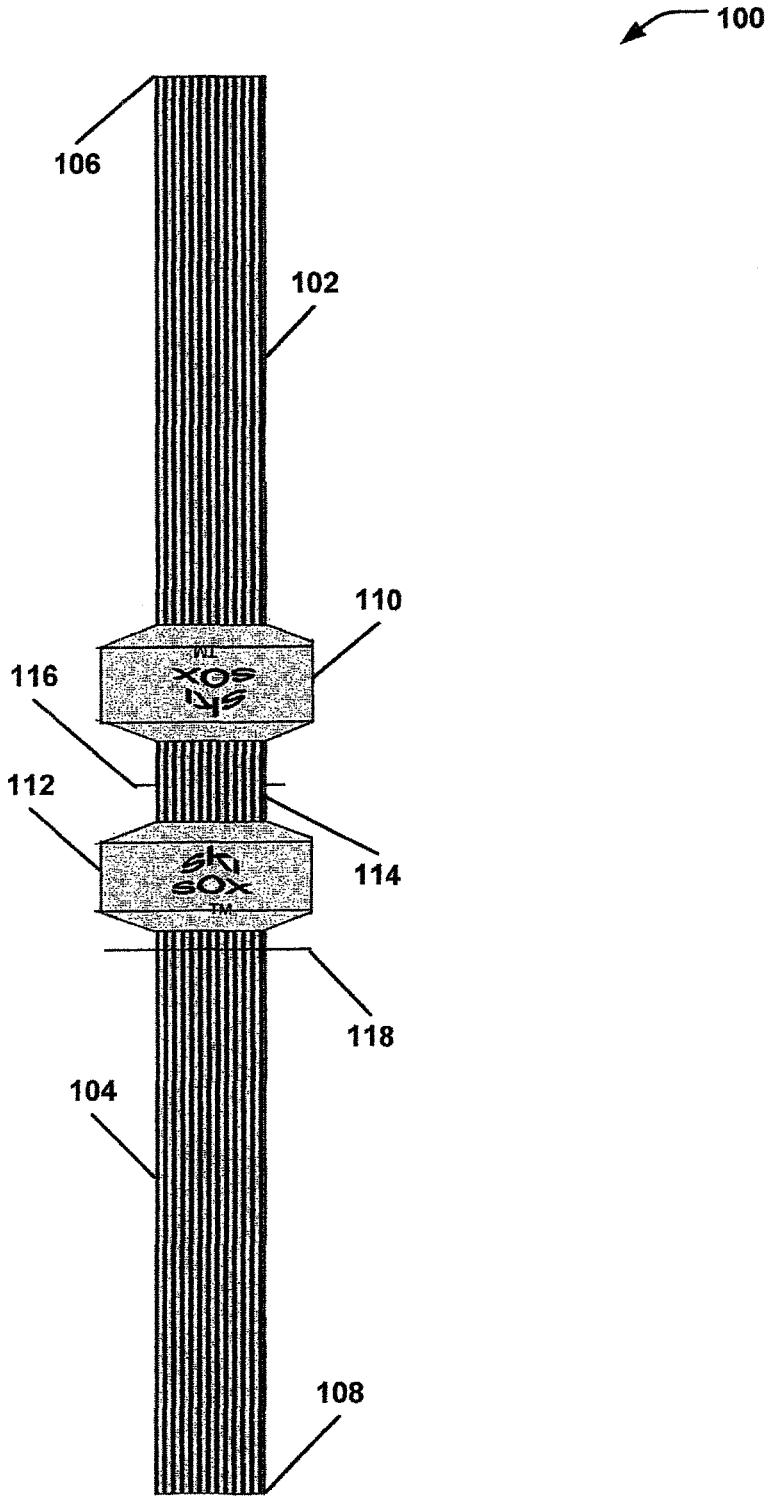
FIG. 1 shows a ski storage system that is consistent with an embodiment of the invention.

Turning more particularly to the drawings, FIG. 1 shows a ski storage system 100 that is consistent with an embodiment of the invention. The ski storage system 100 may include a first sleeve length 102 and a second sleeve length 104. At least one of the first and second sleeve lengths 102, 104 may be manufactured from elastic material blended with polyester or recycled material. Other materials used to manufacture at least one of the first and second sleeve lengths 102, 104 may include bamboo, flan, and hemp.

The first sleeve length 102 of elastic material may include a first aperture 106 configured to receive a first ski (not shown). The second sleeve length 104 of elastic material may include a second aperture 108 configured to receive a second ski (not shown). A hanging fastener (shown in subsequent figures) may be positioned in between the first and second sleeve lengths 102, 104. The hanging fastener may be configured to vertically suspend the first and second sleeve lengths 102, 104.

The ski storage system 100 may further include a first non-elastic section 110 positioned in between the first and second sleeve lengths 102, 104. A second non-elastic section 112 may be positioned in between the first sleeve length 102 and the second sleeve length 104. As shown in FIG. 1, the non-elastic sections may be personalized with at least one of a logo and/or text.

A center elastic section 114 may be positioned in between the first non-elastic section 110 and the second non-elastic section 112. The center elastic section 114 may have a first diameter 116 that may be the same size or a different size than a diameter of the second non-elastic section 112. The differences in material between the sleeve lengths 102, 104 and the center non-elastic sections 110, 112 may facilitate holding and suspending the skis securely.

At least one of the first and second sleeve lengths 102, 104 and/or the center non-elastic sections 110, 112 may include an inner layer comprising a moisture wicking material, such as COOLMAX® material. Overlock stitching may be used proximate the first and second apertures 106, 108 to discourage fraying.

Figure 2:
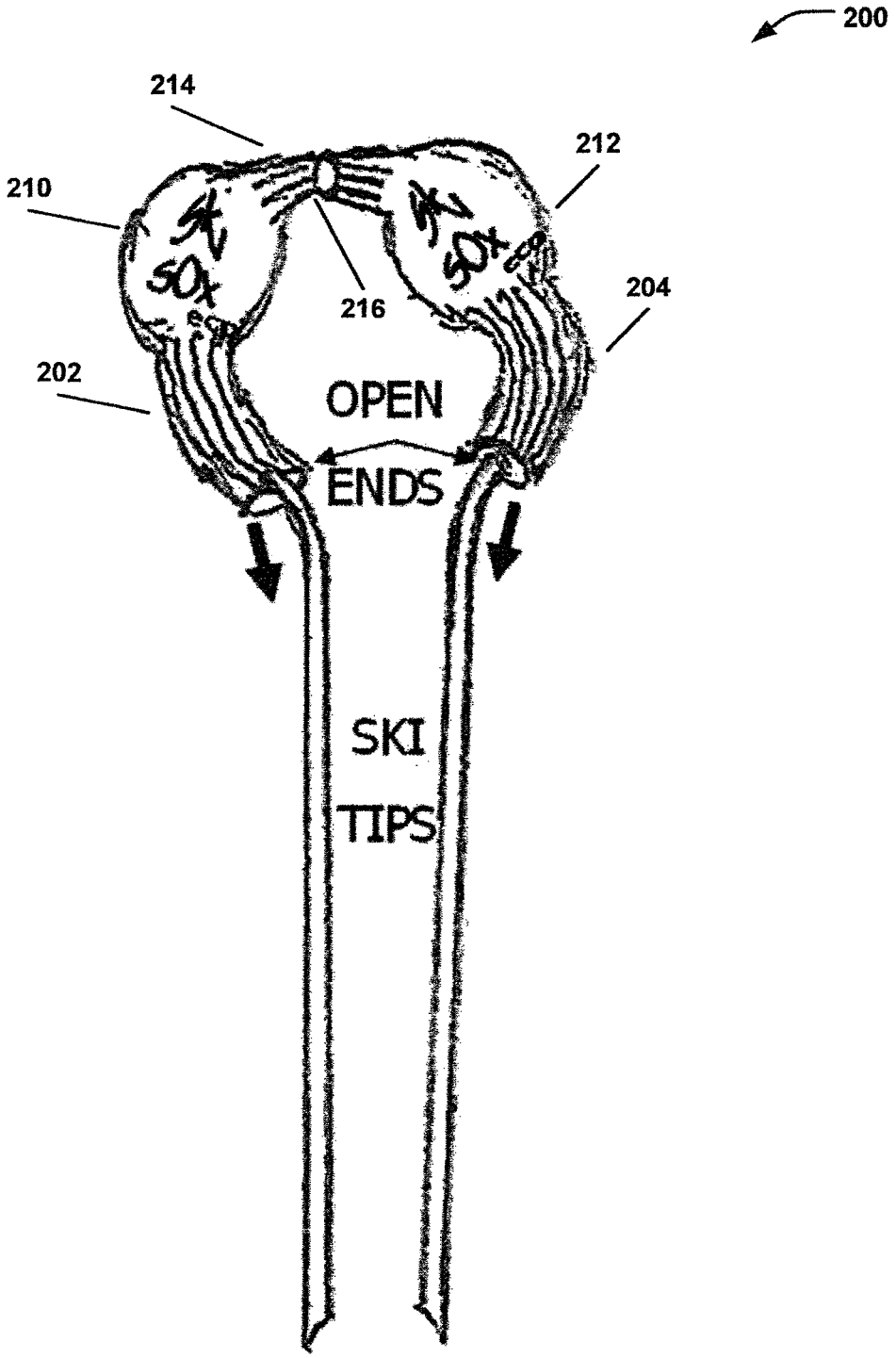
FIG. 2 shows a ski storage system that is similar to the system of FIG. 1 and that is configured to hang from a mounted fastener in a manner consistent with an embodiment of the invention.

FIG. 2 shows an embodiment of ski storage system 200 that is configured to securely suspend skis while removing moisture away from the ski surfaces. The ski storage system 200 may be similar to the ski storage system 100 of FIG. 1. The ski storage system 200 may include a first sleeve length 202 and a second sleeve length 204. The first and second sleeve lengths 202, 204 may have open ends that may be pulled over ski tips. At least one of the first and second sleeve lengths 202, 204 may be manufactured from elastic material blended with polyester or recycled material, among other materials.

The ski storage system 200 may further include a first non-elastic section 210 positioned in between the first and second sleeve lengths 202, 204. A second non-elastic section 212 may be positioned in between the first sleeve length 202 and the second sleeve length 204. As shown in FIG. 2, the non-elastic sections may be personalized with at least one of a logo and/or text. A center elastic section 214 may be positioned in between the first non-elastic section 210 and the second non-elastic section 212.

At least one of the first and second sleeve lengths 202, 204 and/or the center non-elastic sections 212, 214 may include an inner layer comprising a moisture wicking material. Overlock stitching may be used proximate the open ends to discourage fraying.

A hanging fastener 216 may be positioned in between the first and second sleeve lengths 202, 204. The hanging fastener 216 may be configured to vertically suspend the first and second sleeve lengths 202, 204. Hanging by the hanging fastener 216 keeps the skis out of the way and prevents them from falling over. The hanging further prevents wicking moisture from ground.

Figure 3:
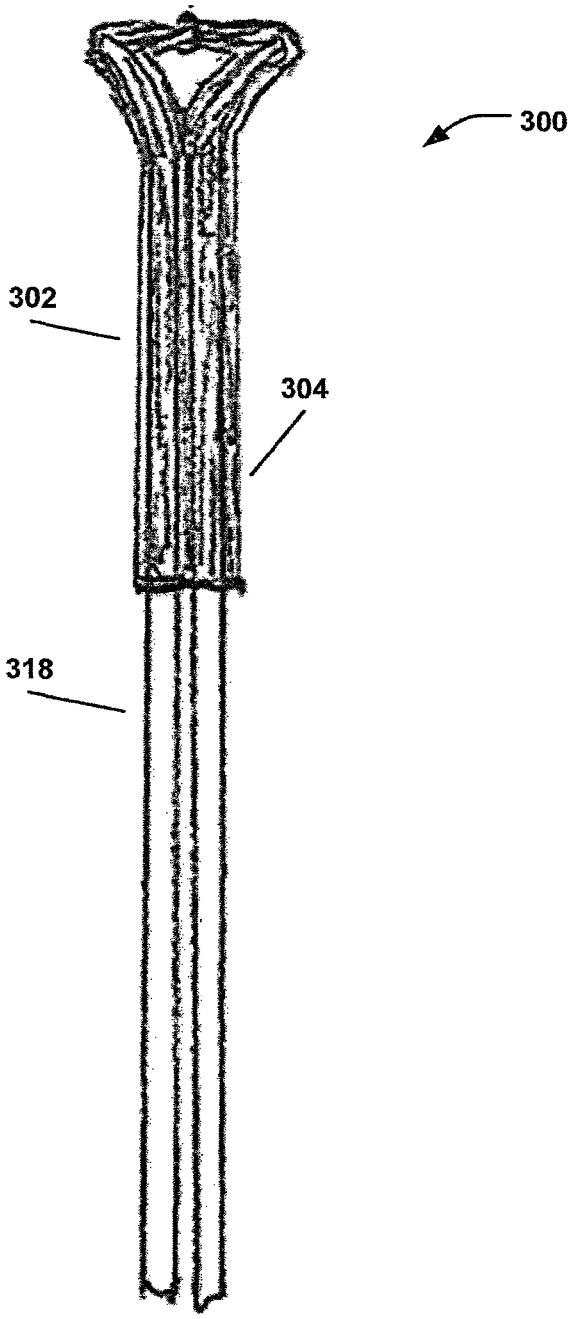
FIG. 3 shows a ski storage system similar to that depicted in FIG. 2 that has been pulled over a pair of skis in a manner consistent with an embodiment of the invention.

FIG. 3 shows a ski storage system 300 similar to that depicted in FIG. 2. As shown in FIG. 3, the ski tips 318 have been fully inserted into the ski storage system 300. The ski tips 318 are made to substantially align as the first and second sleeve lengths 302, 304 have been pulled down over the ski tips 318.

Figure 4:
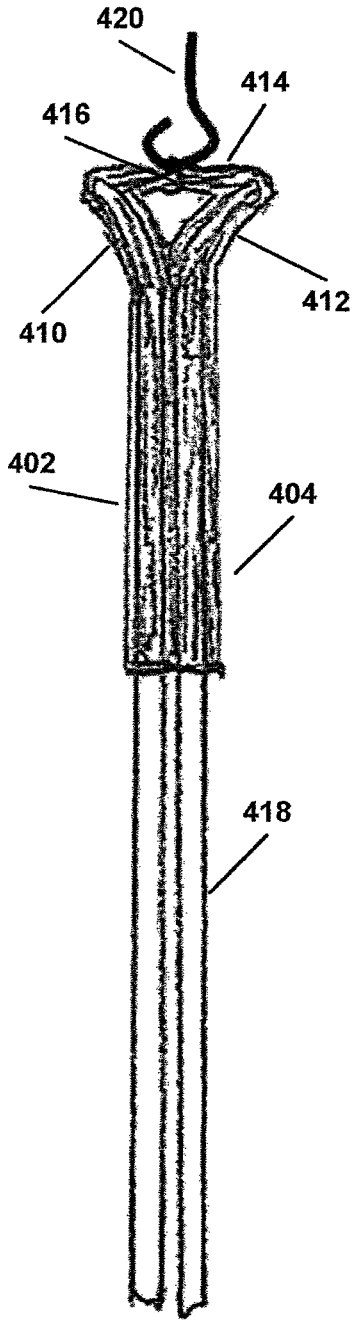
FIG. 4 shows a ski storage system similar to that depicted in FIGS. 2 and 3 that has been hung by its fastening mechanism from a mounting fastener.

FIG. 4 shows a ski storage system 400 similar to that depicted in FIGS. 2 and 3.

As shown in FIG. 4, the ski storage system 400 has been hung using a fastening mechanism 416 to a mounting hook 420. As discussed above, the ski storage system 400 may include polyester and elastic to hold skis 418 securely. Non-elastic middle sections 410, 412 may be included in an embodiment of the ski storage system 400. The non-elastic sections 410, 412 may have the same or a different diameter sleeve than the first or second sleeve lengths 402, 404. The non-elastic sections 410, 412 may facilitate the ski storage system's fitting around the shape of the skis 418. For example, relief (e.g., non-elasticity) in the areas of a non-elastic section 410, 412 may allow the ski storage system 400 conform to help hold and suspend the skis 418. As such, one size of the ski storage system 400 may fit substantially all sizes and shapes of skis 418.

Inner surface(s) of at least one of the sleeves 402, 404 and sections 410, 412, 414 of the ski storage system 400 may be plated or otherwise lined with a moisture-wicking material that draws moisture away from ski edges to avoid rust. Moreover, the fabric may be plated such that moisture is wicked from the entire surface area of the skis 418.

The ski storage system 400 may hold the skis 418 together while keeping two layers of material (e.g., the sleeves 402, 404 or sections 110, 112) between the sharp edges and the delicate bases of the skis 418.

The fastening mechanism 416 may be centered on the ski tips 418. Suspension by the fastening mechanism 416 keeps the skis 418 out of the way and prevents them from falling over. The hanging further removes the skis 418 from ground moisture.

Figure 5:
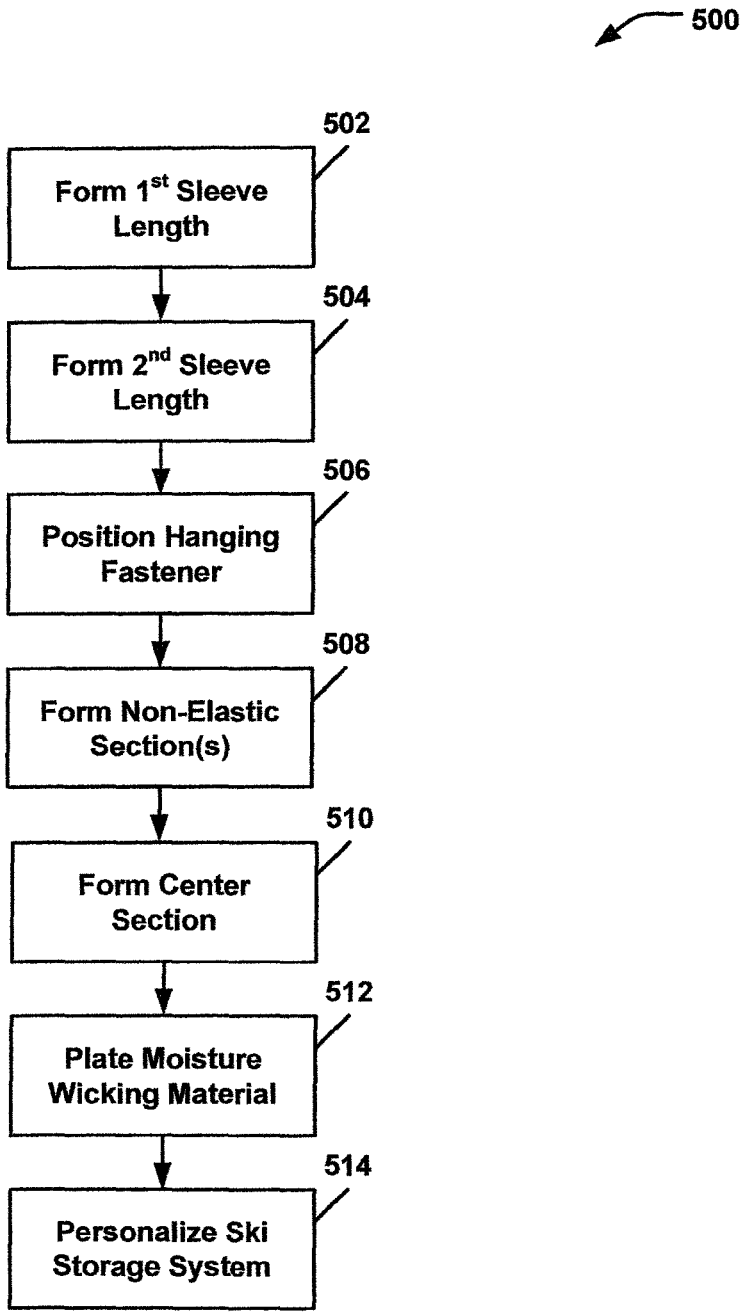
FIG. 5 is a flowchart of an embodiment of a method of manufacturing a ski storage system similar to the embodiments shown in FIGS. 1-4.

FIG. 5 is a flowchart illustrating a method 500 of manufacturing a ski covering that is consistent with an embodiment of the invention. For example, the method 500 may be used manufacture a ski storage system, such as that depicted in FIGS. 1-4, that is configured to suspend skis while preventing scratches and exposure to moisture.

At 502, a first sleeve length of elastic material may be formed. The first sleeve length may include a first aperture configured to receive a first ski. For example, the first sleeve length 302 of FIG. 3 includes an open end to receive a ski tip 318.

A second sleeve length of elastic material may be formed at 504. The second sleeve length may include a second aperture configured to receive a second ski. For instance, the second sleeve length 304 of FIG. 3 includes an open end to receive a ski tip 318.

At 506, a hanging fastener may be positioned in between and configured to vertically suspend the first and the second sleeve lengths. For example, the hanging fastener mechanism 416 of FIG. 4 may be used to suspend the ski storage system 400 and the skis 418 from the ground.

A first non-elastic section may be positioned at 508 in between the first sleeve length and the second sleeve length. In an embodiment, a second non-elastic section may be positioned in between the first sleeve length and the second sleeve length. The sections may be separated by center section, which may be positioned at 510. The center section may comprise elastic in one embodiment. The fastening mechanism may be attached to the center section. The sections and sleeve lengths may cooperate to hold the skis in a vertical position, while providing protective barrier layers between the skis.

An inner layer comprising a moisture wicking material may be plated or otherwise included at 512 inside at least one of the first sleeve length and the second sleeve. Removal of the moisture from the skis may deter rust.

The ski storage system may be personalized at 514 to suit a user. For example, the sections 210, 212 of the ski storage system 200 of FIG. 2 include personalized logos and text.

While the present embodiments have been described in detail, it is not the intention of the Applicant to restrict, or any way limit the scope of the appended claims to such detail. The embodiments in their broader aspects are therefore not limited to the specific details, representative apparatus, methods, and illustrative examples shown and described. Accordingly, departures may be made from such details without departing from the scope of Applicant's general inventive concept.

The invention claimed is:

1. An apparatus, comprising:

a first sleeve length of elastic material comprising a first aperture configured to receive a first ski;

a second sleeve length of elastic material comprising a second aperture configured to receive a second ski;

a first non-elastic section positioned in between the first sleeve length and the second sleeve length; and a hanging fastener positioned in between and configured to vertically suspend the first and the second sleeve lengths.

2. The apparatus of claim 1, further comprising:

another non-elastic section positioned in between the first sleeve length and the second sleeve length; and a center elastic section positioned in between the first non-elastic section and the second non-elastic section.

3. The apparatus of claim 1, wherein at least one of the first sleeve length and the second sleeve length includes an inner layer comprising a moisture wicking material.

4. The apparatus of claim 1, wherein the hanging fastener comprises a hoop mechanism.

5. The apparatus of claim 1, wherein the first sleeve length and the second sleeve length are integrally attached.

6. The apparatus of claim 1, wherein at least one of the first sleeve length, the non-elastic section, and the second sleeve length include at least one of a recycled material and a tear-resistant material.

7. The apparatus of claim 1, wherein at least one of the first sleeve length, the non-elastic section, and the second sleeve length include a material comprising at least one of polyester, bamboo, flan, and hemp.

8. The apparatus of claim 1, wherein at least one of the first sleeve length, the non-elastic section, and the second sleeve length are personalized with at least one of a logo and text.

9. A method of manufacturing a ski covering, the method comprising:

forming a first sleeve length of elastic material comprising a first aperture configured to receive a first ski;

forming a second sleeve length of elastic material comprising a second aperture configured to receive a second ski;

including an overlock stitch proximate at least one of the first and second apertures; and positioning a hanging fastener in between and configured to vertically suspend the first and the second sleeve lengths.

10. The method of claim 9, further comprising positioning a non-elastic section in between the first sleeve length and the second sleeve length.

11. The method of claim 10, further comprising personalizing at least one of the first sleeve length, the non-elastic section, and the second sleeve length with at least one of a logo and text.

12. The method of claim 9, further comprising including an inner layer comprising a moisture wicking material inside at least one of the first sleeve length and the second sleeve.

13. The method of claim 9, further comprising using an overlock stitch proximate the aperture.

14. The apparatus of claim 9, wherein the hanging fastener comprises a hoop mechanism.

15. The method of claim 9, further comprising integrally attaching the first sleeve length and the second sleeve length.

16. The method of claim 9, further comprising forming at least one of the first sleeve length and the second sleeve length using a round, unspun fiber.

17. The method of claim 9, further comprising forming at least one of the first sleeve length, a non-elastic section, and the second sleeve length using at least one of a recycled material, polyester, bamboo, flan, and hemp.

18. An apparatus, comprising:

a first sleeve length of elastic material comprising a first aperture configured to receive a first ski;

a second sleeve length of elastic material comprising a second aperture configured to receive a second ski, wherein at least one of the first sleeve length and the second sleeve length include a round or unspun fiber; and a hanging fastener positioned in between and configured to vertically suspend the first and the second sleeve lengths.

* * * * *